US005996299A

United States Patent [19]

Hsueh

[11] Patent Number: 5,996,299

[45] Date of Patent: Dec. 7, 1999

[54] PARTITION WALL MATERIAL

[76] Inventor: Yi-Cheng Hsueh, No. 28-1, Lane 195, Yung Fong Road, Tu Cheng, Taipei Hsien, Taiwan

[21] Appl. No.: 09/203,742

[22] Filed: Dec. 2, 1998

[30] Foreign Application Priority Data

Feb. 21, 1998 [TW] Taiwan ..... 87202511

[51] Int. Cl.[6] ..... E04C 2/34

[52] U.S. Cl. ..... 52/481.2; 52/489.1; 52/479; 52/511; 52/586.1; 52/656.1

[58] Field of Search ..... 52/479, 481.1, 52/481.2, 489.1, 511, 586.1, 656.1, 239

[56] References Cited

U.S. PATENT DOCUMENTS

| | | | |
|---|---|---|---|
| 3,686,810 | 8/1972 | Allen | 52/243 |
| 3,705,471 | 12/1972 | Allen | 52/243 |
| 3,731,447 | 5/1973 | Dawdy et al. | 52/489 |
| 3,753,325 | 8/1973 | Stanley et al. | 52/489 |
| 3,922,764 | 12/1975 | Downing, Jr. | 24/259 |
| 3,998,018 | 12/1976 | Hodges | 52/481 |
| 5,537,795 | 7/1996 | Dias | 52/586.2 |
| 5,855,100 | 1/1999 | Hsueh | 52/481.2 |

*Primary Examiner*—Carl D. Friedman
*Assistant Examiner*—Yvonne Horton-Richardson
*Attorney, Agent, or Firm*—Dougherty & Troxell

[57] ABSTRACT

An improved partition wall material including a skeletal material, partition boards, and fastening plates. The skeletal material is an elongated extruded structure including a beam at a central portion thereof, and two skeletal projections respectively connected to two ends of the beam, each skeletal projection having two ends that respectively bend outwardly to form respective projection ends. Each projection end is connected to a frame. Each frame includes a frame projection provided with a pair of opposed frame hooks, each of which has a curved portion. The skeletal projection and the frames on both sides thereof defining a frame recess. The partition boards are planar boards including a plurality of locking holes arranged along a longitudinal axis thereof. The fastening plates are integrally bent plates that have one end forming a curved hooking portion corresponding to the frame hook, with the other end forming a straight portion that, together with the hooking portion, is engageable with the corresponding frame hooks. The fastening plate further has a rear hole adapted for passage of a screw therethrough to lock the fastening plate to the corresponding locking hole of the corresponding partition board. The fastening plates and the frames of the skeletal material are thereby inter-connected to enable the partition boards to be secured to the skeletal material.

6 Claims, 3 Drawing Sheets

PARTITION WALL MATERIAL

BACKGROUND OF THE INVENTION 1. (a) Field of the Invention

The present invention relates generally to an improved partition wall material, and more particularly to an improved partition wall material in which the partition boards will not easily detach from the skeletal materials, and assembly of which is simple and convenient.

2. (b) Description of the Prior Art

In space partitioning, conventional brick walls or plywood boards appear to be rigid, dull, and monotonous in certain environments. In today's world where people want changes and varieties, the so-called flexible partitioning has come into being.

Take offices and clean rooms as an example. As users have different requirements, construction companies usually do not partition the interior spaces after completing office buildings or premises, and the users have to partition the interior spaces according to their requirements.

The so-called flexible partitioning that are commonly seen today in general include using modular wall materials that match partition boards, screws, etc., to partition spaces of a work site using the required tools and equipment. There are various drawbacks with the conventional flexible partitioning. For instance, after the interior spaces have been measured, tools such as drills have to be used to construct the partitions on site, which will cause pollution, such as noise pollution and dust, in the work site. For clean rooms, the problems are even more severe. In addition, as the conventional partition board materials are joined to the wall materials in partitioning, gaps easily result after joining, which will affect the sound-proof and dust-proof effects. Furthermore, in the prior art, partitioning is achieved by using a plurality of wall materials connected in series. After joining or assembly, the wall materials may easy shake or even become distorted or cannot be positioned. On the other hand, since prior partition boards are usually single boards, they cannot meet the demands of users who like varieties in terms of color. Although there have been developed block type partition boards to improve the problems with the prior art, as the partition boards and the wall materials are inter-connected using snap fasteners, the sound-proof and dust-proof effects are unsatisfactory, and the boards can be easily detached from the wall materials easily.

SUMMARY OF THE INVENTION

A primary object of the present invention is to provide an improved partition wall material, in which the partition boards will not easily detach from the skeletal materials, and assembly is simple and convenient.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
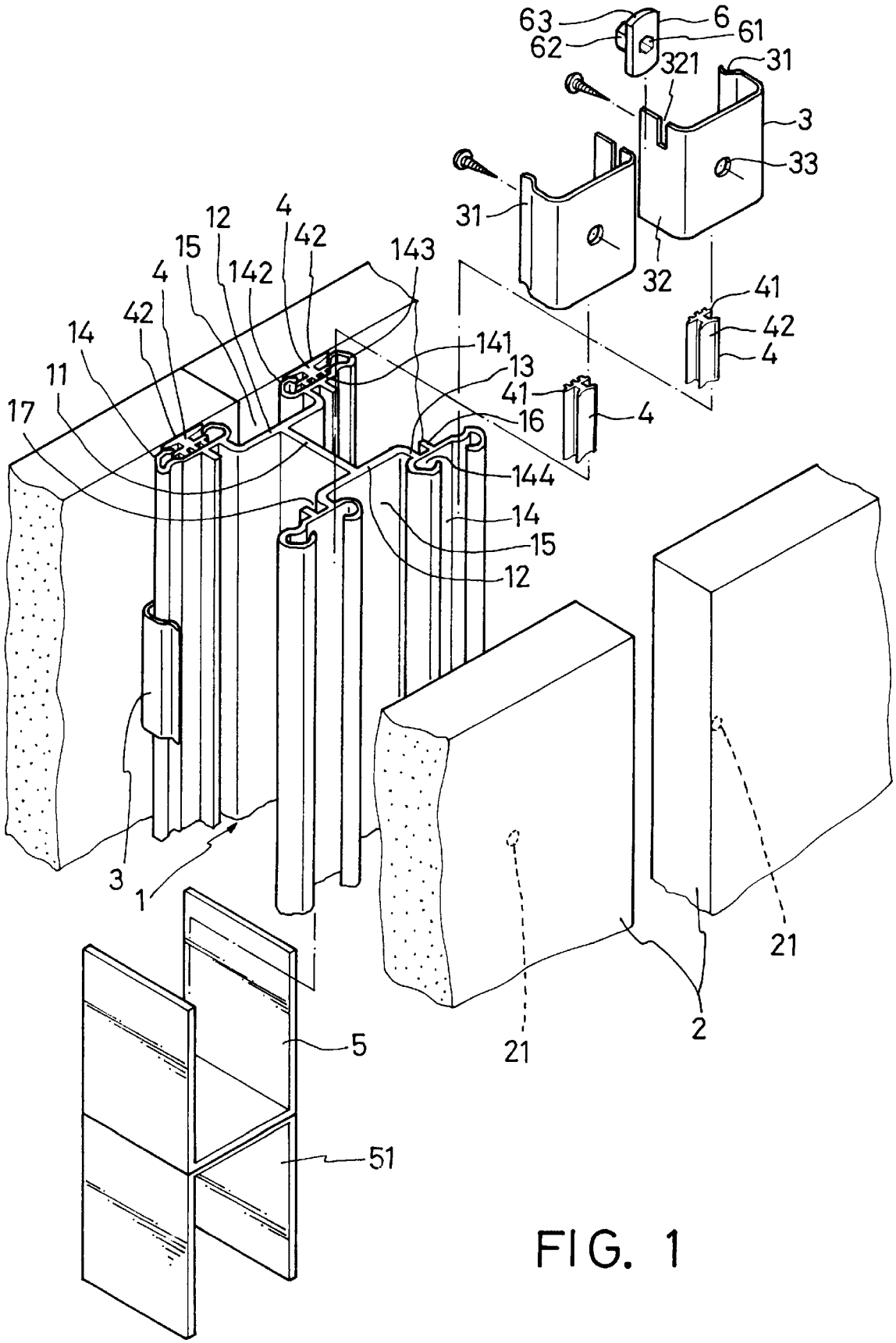
FIG. 1 is a perspective exploded schematic view of the partition wall materials according to the present invention.
Figure 2:
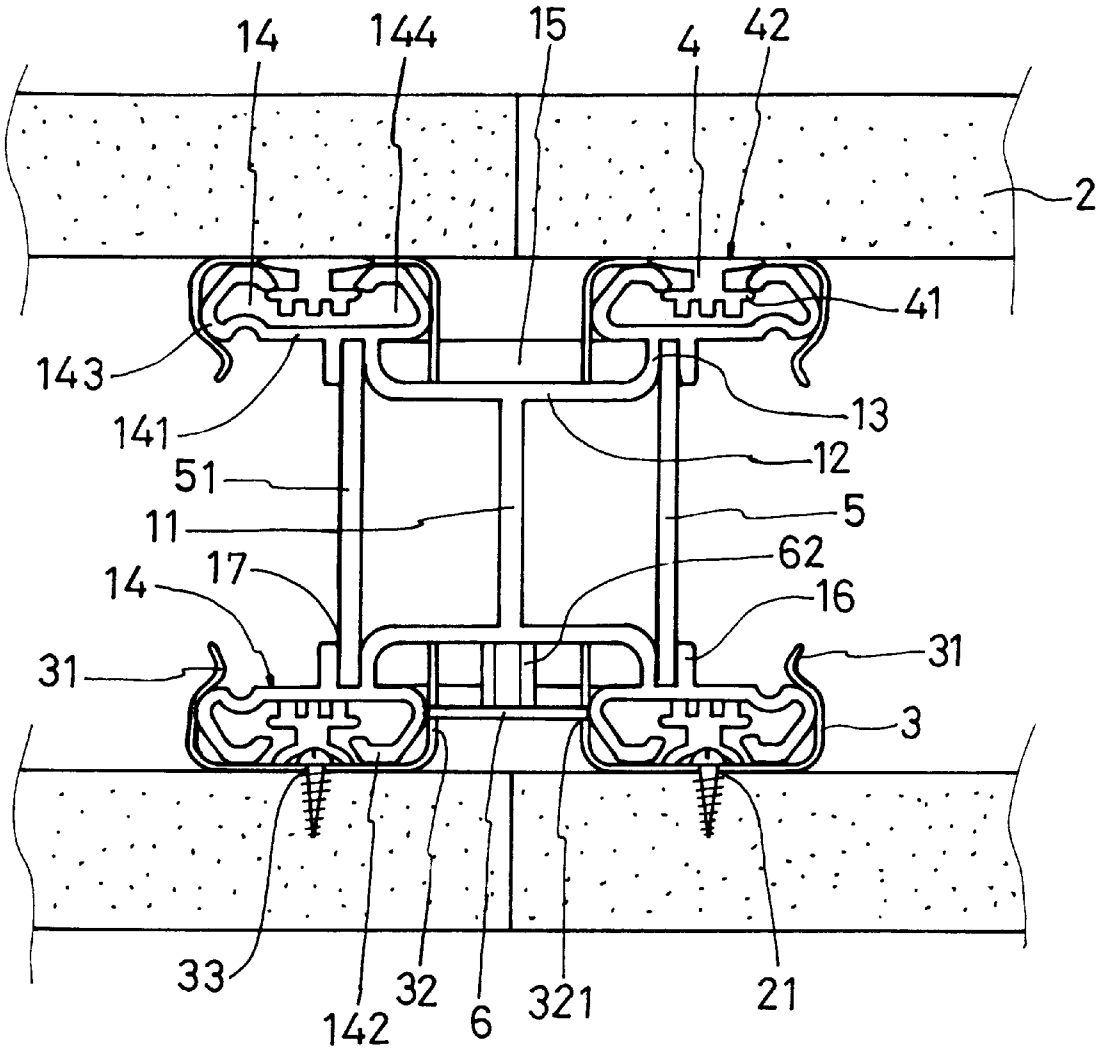
FIG. 2 is a sectional schematic view of the present invention after assembly.
Figure 3:
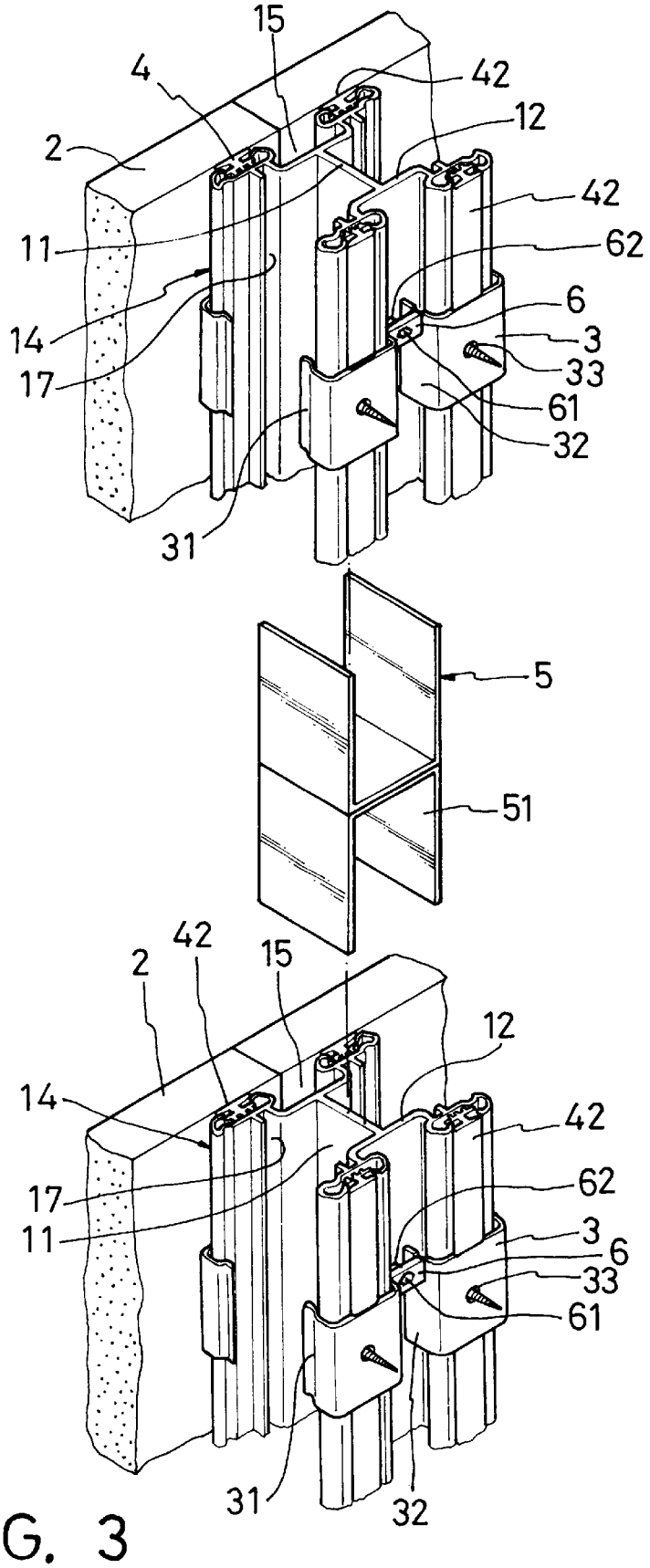
FIG. 3 is a perspective view of the present invention after assembly.

With reference to FIGS. 1–3, the partition wall material according to the present invention comprises a skeletal material 1, partition boards 2, fastening plates 3.

The skeletal material 1 is an elongated extruded structure including a skeletal beam 11, a skeletal projection 12 at each end of the skeletal beam 11, each skeletal projection 12 having two ends that bend outwardly to form respective projection ends 13 that are each connected to a frame 14. The four frames 14 at the four corners of the skeletal material 1 each include a frame projection 141, a pair of opposite frame hooks 142 provided on both ends of the frame projection 141 respectively, and curved portions 143 at respective ends of the frame hooks 142 for engaging and positioning the fastening plates 3. In addition, each skeletal projection 12 and the frames 14 on both ends thereof define a frame recess 15 for receiving and passage of wires, such as power lines, telephone lines, and computer signal lines.

Furthermore, in order to adapt to high partitions, such as partitioning of premises of a greater height, in order to meet length requirements of skeletal materials during transportation, each frame projection 141 is provided with a vertically disposed rib 16 on a bottom portion thereof at a suitable position. The rib 16 and the projection end 13 together define a connecting groove 17. The two pairs of opposedly arranged connecting grooves 17 of the skeletal material 1 can be insertably engaged with two connecting plates 51 at a lower portion of a substantially H-shaped connecting material 5 disposed below, whereas the connecting plates 51 at the upper portion of the connecting material 5 are coupled to the opposite pairs of connecting grooves 17 of another skeletal material 1, thereby allowing longitudinal extension of the skeletal materials 1.

Each two frame hooks 142 enclose and define an insert groove 144 having an opening for insertion therein an elongated hold-down strip 4 so as to achieve better attachment to the partition board 2, further providing good sound-proof and dust-proof effects. The hold-down strip 4 is made of high molecular materials and is provided with a corner rib 41 that corresponds to a respective one of the frame hooks 142 so that they may be butt joined without detachment. Each of the corner ribs 41 forms an outwardly extended curved plate 42 that corresponds to the opening end of the insert groove 144 and disposed between the partition board 2 and each frame hook 142 so as to ensure the sound-proof and dust-proof effects.

The partition board 2 is a planar board that in practice may be a whole piece of board or a rectangular block. Both sides of the partition board 2 are provided with a plurality of locking holes 21 that run longitudinally for fastening with the fastening plates 3. In order not to affect the appearance of the partition board 2, the locking holes 21 are not bored therethrough.

The fastening plate is an integral, bent metal plate. One end thereof forms a curved hooking portion 31 that corresponds to the frame hook 15 so that it can engage the curved portion 143. The other end thereof forms a straight portion 32 that is adapted to contact the corresponding frame hook 15. The fastening plate 3 has a rear hole 33 for passage of a screw therethrough to lock it to the above-mentioned locking hole 21.

In order that the fastening plate 3 does not easily separate from the skeletal material 3, i.e., to secure the partition board 2 firmly on the skeletal material 1, upper and lower ends of the straight portion 32 of the fastening plate 3 are respectively provided with a retaining groove 321. Additionally, there is provided a rectangular retaining plate 6 having a plate hole 61 . The retaining plate 6 is disposed in the frame groove 15 and is turned about 90 degrees. Since the retaining plate 6 has a plate projection 62 on an inner side thereof that has a height the same as the distance between the retaining groove 321 and a bottom edge of the straight portion 32, longer end edges 63 on both sides of the retaining plate 6 may respectively insert into the retaining grooves 321 of two opposedly disposed fastening plates 3, thereby securing one end of the fastening plate 3. In this way, it will not be easy to remove the fastening plate 3 along with the partition board 2 from the skeletal material 1, thus ensuring stability of the partition boards 2 and privacy.

With reference to FIGS. 1–3, to assemble the present invention, the fastening plate 3 is firstly locked to the locking hole 21 of the partition board 2 to join them together. Then the curved hooking portions 31 and the straight portions 32 of the fastening plate 3 are fastened to the corresponding two frame hooks 142 on one side of the skeletal material 1, which has been joined to a baseboard (the joining of the skeletal material to the baseboard is the subject of another patent application). By means of the expansion and retraction of the curved hooking portion 31 and the straight portions 32, the fastening plate 3 can be secured on the frame s14 and enable the partition board 2 to be secured on the skeletal material 1, thus accomplishing assembly of the present invention. By means of joining the hold-down strip 4 and the frame 14, the curved plate 42 can be attached tightly to the partition board 2 to achieve better sound-proof and dust-proof effects.

In addition, in environments where the retaining plates 6 are not installed, to remove or replace the partition board, it is only necessary to pull the partition board 2 so that the fastening plate 3 and the frame 14 are separated to allow removal of the partition board from the skeletal material 1 along with the fastening plate 3, which is very convenient and simple.

Furthermore, if the site has a greater height, the connecting end of the skeletal material 1 can be inserted in a connecting material 5 to join them together to thereby facilitate construction of clean rooms, for instance.

It can be appreciated from the aforesaid that the skeletal materials can be extended in dual directions, and the partition boards may be a whole piece of board or blocks. Assembly of the present invention is quick; besides, it is only necessary to lock the fastening plates and the partition boards. The arrangement of the hold-down strips further achieves sound-proof and dust-proof effects. In addition, by means of the connecting materials, the present invention can be adapted to suit interior spaces of a greater height. Furthermore, due to the arrangement of the engagement of the retaining plates and the fastening plates, the partition boards cannot be easily pulled apart from each other or damaged, thus enhancing the facility in construction and saving labor and tools.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved partition wall material, comprising:

a skeletal material, that is an elongated extruded structure including a beam at a central portion thereof, and two skeletal projections respectively connected to two ends of said beam, each skeletal projection having two ends that respectively bend outwardly to form respective projection ends, each of said projection ends being connected to a frame, said frames each including a frame projection provided with a pair of opposed frame hooks, each of which has a curved portion, said skeletal projection and the frames on both sides thereof defining a frame recess;

partition boards, each of which is a planar board including a plurality of locking holes arranged along a longitudinal axis thereof; and fastening plates, each of which is an integrally bent plate that has one end forming a curved hooking portion corresponding to said frame hook, with the other end forming a straight portion that, together with said hooking portion, is engageable with the corresponding frame hooks, said fastening plate further having a rear hole adapted for passage of a screw therethrough to lock said fastening plate to the corresponding locking hole of the corresponding partition board; whereby said fastening plates and said frames of said skeletal material are inter-connected to enable said partition boards to be secured to said skeletal material.

2. The improved partition wall material as defined in claim 1, wherein each of said frames is provided with a skeletal rib on a bottom portion thereof, said skeletal rib forming a connecting groove with said projection end so that said skeletal material has two pairs of opposedly arranged connecting grooves that can be adapted to receive two connecting plates at a lower portion of a substantially H-shaped connecting material, said connecting plate further having connecting plates at an upper portion thereof that are joined to the connecting grooves of another skeletal material to achieve extension of skeletal materials in a longitudinal direction.

3. The improved partition wall material as defined in claim 1, wherein said two frame hooks of said frame define an opening end having an insert groove for receiving an elongated hold-down strip inserted therein, so that said skeletal material can be positively attached to said partition boards.

4. The improved partition wall material as defined in claim 3, wherein said hold-down strip is made of high molecular materials and is provided with respective corner ribs corresponding to and connected to opening ends of frame hooks on both sides thereof, each of said corner ribs at said opening end of said insert groove extending outwardly to form an outwardly extended curved plate, that is disposed between said partition board and each of said frame hook to thereby achieve better sound-proof and dust-proof effects.

5. The improved partition wall material as defined in claim 1, wherein said partition boards may be whole pieces of boards or blocks.

6. The improved partition wall material as defined in claim 1, wherein said straight portion of each of said fastening plate is provided with respective retaining grooves at upper and lower ends thereof, a plate hole of a rectangular retaining plate being connected to a tool and disposed in said frame groove and turned about 90 degrees, whereby due to the height of a plate projection on an inner side of said retaining plate, long end edges on both sides of said retaining plate being respectively inserted into two opposedly disposed retaining grooves of said fastening plate to thereby secure one end of said fastening plate so that said fastening plate will not detach from said skeletal material.

* * * * *